US006624398B2

(12) United States Patent
Sherrill et al.

(10) Patent No.: US 6,624,398 B2
(45) Date of Patent: Sep. 23, 2003

(54) INSULATOR SUPPORT STRUCTURE FOR A HEATER ASSEMBLY

(75) Inventors: Jimmy L. Sherrill, Cookeville, TN (US); Ike D. Walker, Monterey, TN (US)

(73) Assignee: Tutco, Inc., Cookeville, TN (US)

( * ) Notice: Subject to any disclaimer, the term of this patent is extended or adjusted under 35 U.S.C. 154(b) by 30 days.

(21) Appl. No.: 09/997,252

(22) Filed: Nov. 30, 2001

(65) Prior Publication Data

US 2003/0102301 A1 Jun. 5, 2003

(51) Int. Cl.[7] ..... H05B 3/06
(52) U.S. Cl. ..... 219/536
(58) Field of Search ..... 219/536, 542, 219/841; 174/138

(56) References Cited

U.S. PATENT DOCUMENTS

| | | | | |
|---|---|---|---|---|
| 3,631,525 A | | 12/1971 | Brasch | |
| 3,641,312 A | | 2/1972 | Ammerman et al. | |
| 3,770,939 A | | 11/1973 | Kokjohn | |
| 3,811,031 A | | 5/1974 | McBride et al. | |
| 3,890,487 A | | 6/1975 | Wightman et al. | |
| 4,289,955 A | | 9/1981 | Seeley | |
| 4,472,624 A | | 9/1984 | Janning | |
| 4,492,851 A | * | 1/1985 | Carr | 219/201 |
| 4,531,017 A | * | 7/1985 | Sherrill | 174/138 J |
| 4,617,547 A | * | 10/1986 | Howard et al. | 338/317 |
| 4,628,189 A | * | 12/1986 | Danko | 219/532 |
| 5,641,420 A | | 6/1997 | Peterson et al. | |
| 5,925,273 A | * | 7/1999 | Sherrill | 219/478 |
| 5,954,983 A | * | 9/1999 | Holmes | 219/536 |
| 5,959,254 A | * | 9/1999 | Martin, Sr. | 174/138 J |
| 6,078,730 A | * | 6/2000 | Huddart et al. | 392/480 |
| 6,097,003 A | | 8/2000 | Markum et al. | |
| 6,160,957 A | * | 12/2000 | Johansson | 392/434 |
| 6,359,262 B1 | * | 3/2002 | Robertson et al. | 219/407 |
| 6,433,318 B2 | * | 8/2002 | Danko | 219/536 |
| 6,509,554 B2 | * | 1/2003 | Howard et al. | 219/536 |

* cited by examiner

*Primary Examiner*—Teresa Walberg
*Assistant Examiner*—Vinod D. Patel
(74) *Attorney, Agent, or Firm*—Clark & Brody

(57) ABSTRACT

A heater assembly includes a mounting structure, a securement structure, an insulator support structure, a conducting structure having a first portion and a second portion, a terminal structure, and a thermostat structure. The securement structure cooperates with the insulator support structure and the mounting structure to releasably and fixedly secure the insulator support structure to the mounting structure. The terminal structure is coupled to the first portion of the conducting structure, and is used to deliver power to the conducting structure. The thermostat structure is coupled to the second portion of the conducting structure. The insulator support structure is configured to cooperate with both the terminal structure and the thermostat structure to fixedly support the terminal structure or the thermostat structure in position.

75 Claims, 6 Drawing Sheets

INSULATOR SUPPORT STRUCTURE FOR A HEATER ASSEMBLY

FIELD OF THE INVENTION

The present invention relates in general to heater assemblies. In particular, the present invention relates to heater assemblies with an improved insulator support structure.

BACKGROUND OF THE INVENTION

It is known to use in-line thermostats with electric heater assemblies whose open coil elements are supported using ceramic insulators that are retained in position by a metal rod completely or partially encircling each ceramic insulator. Insulators supporting the in-line thermostats are themselves supported by metal rods as well. Moreover, the metal rods supporting the insulators are welded to a metal frame.

Certain open coil electric heaters, however, have improved systems for supporting the insulators retaining the heater coils. One heater assembly includes insulators held in place by metal clips welded to frame bars. Another heater assembly includes insulators supported by metal clips clinched to T-shaped cross section frame bars.

These heater assemblies, however, have limitations when using in-line thermostats. For example, a limitation for the heater assembly having insulators retained by clips welded to frame bars is that two different types of ceramic supports are needed. As a result, the heater assembly includes two different types of insulators and two different types of metal support clips. Special handling, specialized tooling and fixtures, non-standard manufacturing procedures and increased inventories due to higher part counts, for example, result in higher manufacturing cost than otherwise would be realized with more standardized parts.

The heater assembly having clips clinched to T-shaped frame bars is subject to these same limitations. Moreover, clips presently used to retain in-line thermostats cannot be attached, in an operative manner, to T-shaped cross section bars. Accordingly, heaters having in-line thermostats and T-shaped cross section bars are not presently feasible to manufacture because clips used to retain the in-line thermostat cannot be mounted to the T-shaped cross section bars.

SUMMARY

One embodiment of the present invention provides a heater assembly, including a mounting structure, a securement structure, an insulator support structure, a conducting structure having a first portion and a second portion, a terminal structure, and a thermostat structure. The securement structure cooperates with the insulator support structure and the mounting structure to releasably and fixedly secure the insulator support structure to the mounting structure. The terminal structure is coupled to the first portion of the conducting structure, and is used to deliver power to the conducting structure. The thermostat structure is coupled to the second portion of the conducting structure. The insulator support structure is configured to cooperate with both the terminal structure and the thermostat structure to fixedly support the terminal structure or the thermostat structure in position.

BRIEF DESCRIPTION OF THE DRAWINGS

In the drawings, like reference numerals represent similar parts of the illustrated embodiments of the present invention throughout the several views and wherein.

DETAILED DESCRIPTION

Figure 1:
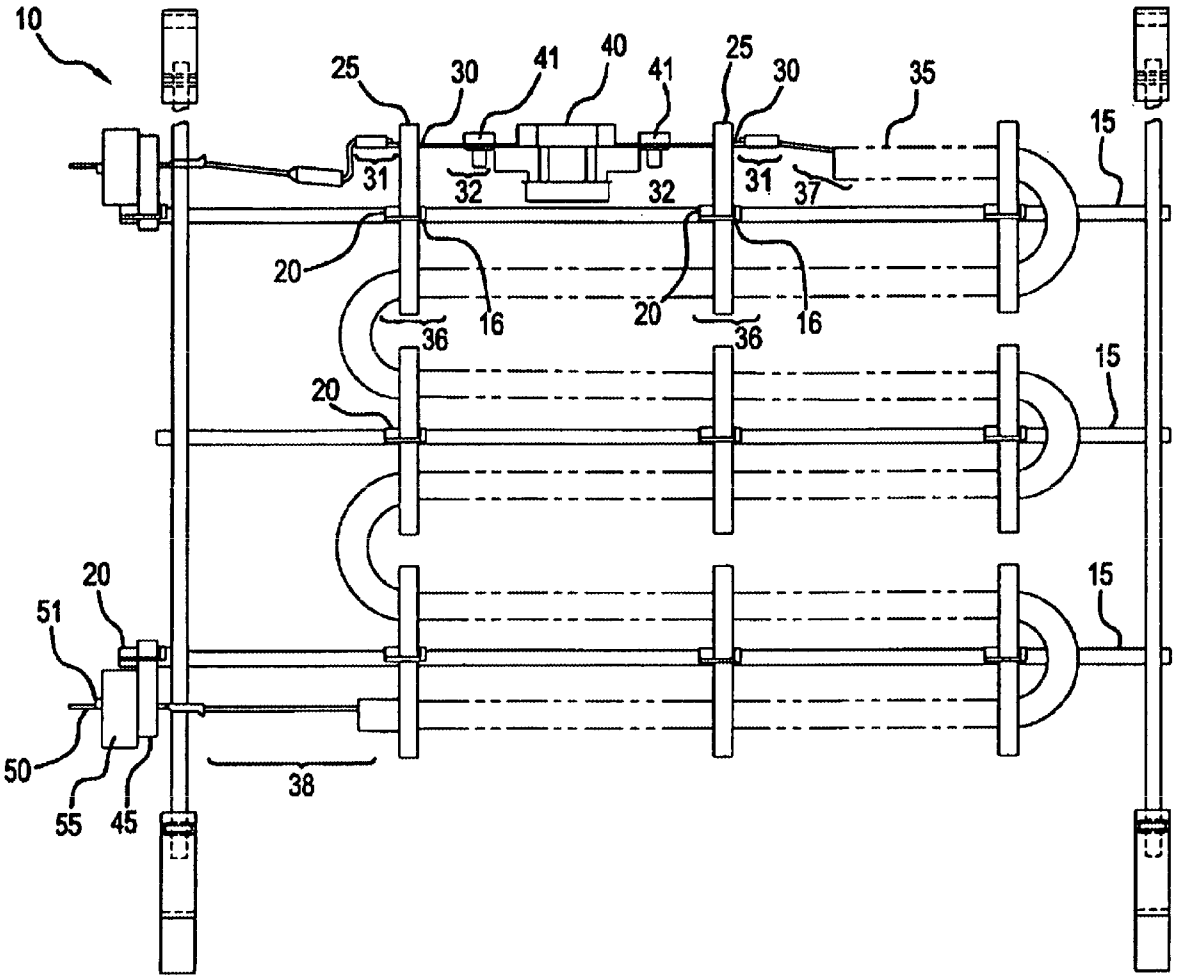
FIG. 1 is a top view of an embodiment of a heater assembly.

FIG. 1 illustrates a top view of one embodiment of a heater assembly 10, including a mounting structure 15, a securement structure 20, an insulator support structure 25, a terminal structure 30, a conducting structure 35, and a thermostat structure 40. The thermostat structure 40 may include an in-line thermostat structure.

Figure 2A:
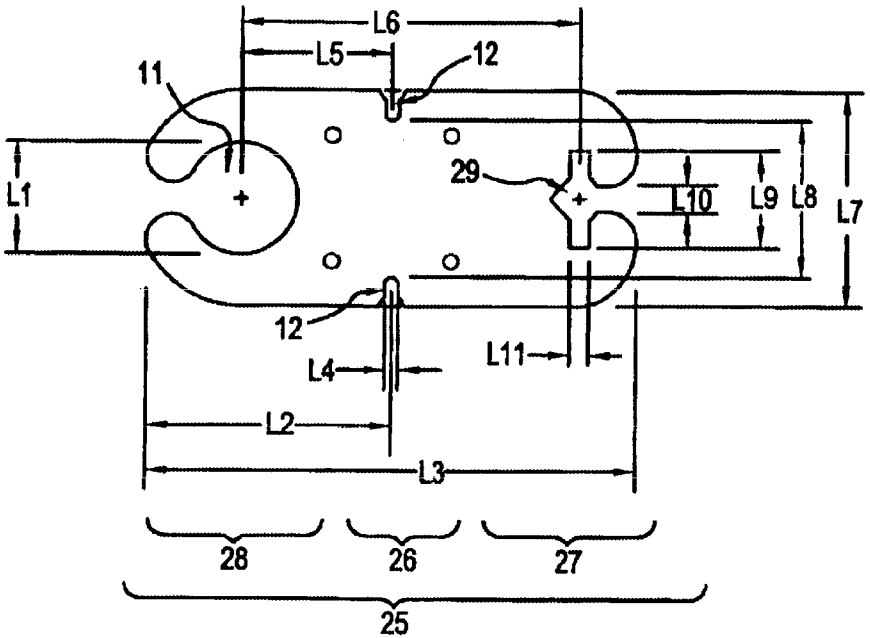
FIGS. 2A and 2B are a side view and a top view, respectively, of an insulator support structure in accordance with the embodiment of FIG. 1.
Figure 2B:
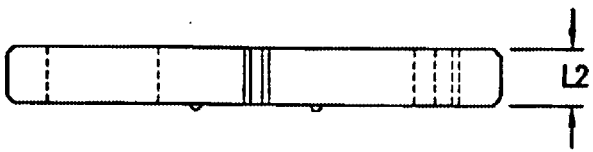

The insulator support structure 25 includes a first portion 26, a second portion 27, and a third portion 28 (see FIG. 2). The first portion 26 of the insulator support structure 25 may include a center portion. The second portion 27 of the insulator support structure 25 may include a first end portion, and a terminal receiving opening 29 formed therethrough. The third portion 28 of the insulator support structure 25 may include a second end portion, and a conductor receiving opening 11 formed therethrough. The terminal receiving opening 29 and/or the conductor receiving opening 11 of the insulator support structure 25 may extend to an outer edge portion of the insulator support structure 25. The size of the insulator support structure 25 may include the following measurements (see FIGS. 2A and 2B): L1=0.450 in.; L2=1.014 in.; L3=2.029 in.; L4=0.050 in.; L5=0.625 in.; L6=1.406 in.; L7=0.870 in.; L8=0.625 in.; L9=0.395 in.; L10=0.125 in.; L11=0.070 in.; and L12=0.208 in.

Figure 11:
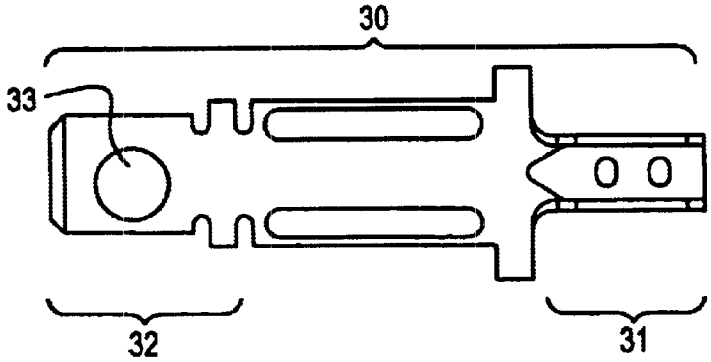
FIG. 11 is a top view of one embodiment of a terminal structure.

The terminal structure 30 includes a first portion 31, and a second portion 32 (see FIG. 11). The conducting structure 35 includes a first portion 36, and a second portion 37 (see FIG. 1).

The securement structure 20 cooperates with the first portion 26 of the insulator support structure 25 and the mounting structure 15 to releasably and fixedly secure the insulator support structure 25 to the mounting structure 15. The securement structure 20 (see FIGS. 6 and 7) may include a first portion 21 to engage with the first portion 26 of the insulator support structure 25, and a second portion 22 to engage with the mounting structure 15. The first portion 21 and the second portion 22 of the securement structure 20 may include a tab (e.g., a projection). The first portion 26 of the insulator support structure 25 may include a tab receiving opening 12 (see FIG. 2) to receive the tab 21. The second portion 22 of the securement structure 20 may be welded and/or clinched to the mounting structure 15.

Figure 6:
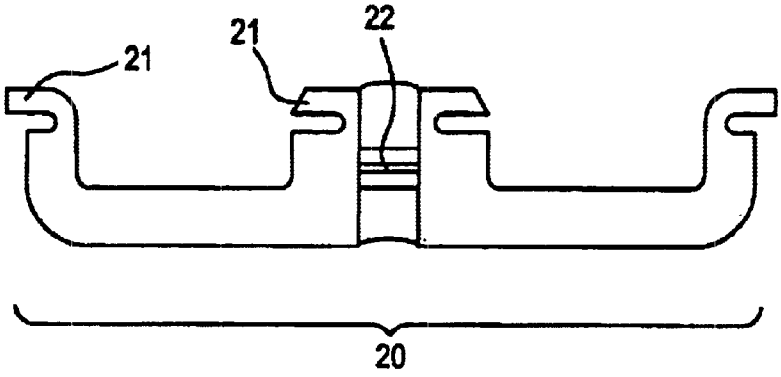
FIG. 6 is a side view of one embodiment of a welding clip.
Figure 7:
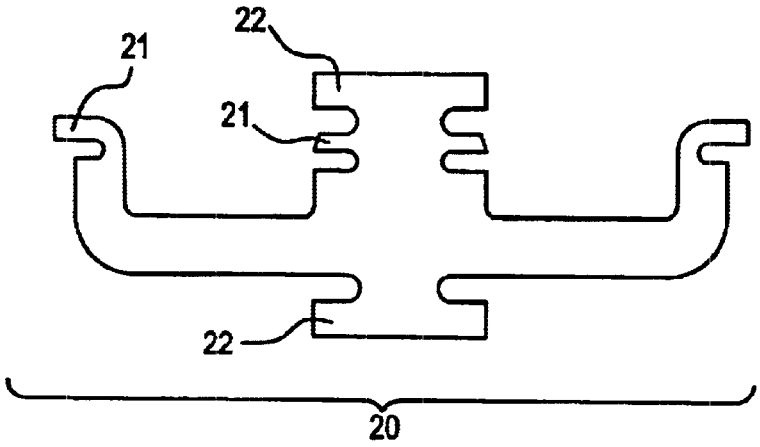
FIG. 7 is a side view of one embodiment of a clinching clip.

FIG. 6 illustrates one embodiment of a clip (e.g., a double welding clip), and FIG. 7 illustrates another embodiment of a clip (e.g., a double clinching clip), each of which may be used to secure a pair of insulator support structures 25 to the mounting structure 15. The securement structure 20, however, may include a double clip, illustrated in FIGS. 6 and 7, and/or a half clip, illustrated in FIG. 1. The half clip may be used to secure a single insulator support structure 25 to the mounting structure 15.

Figure 8:
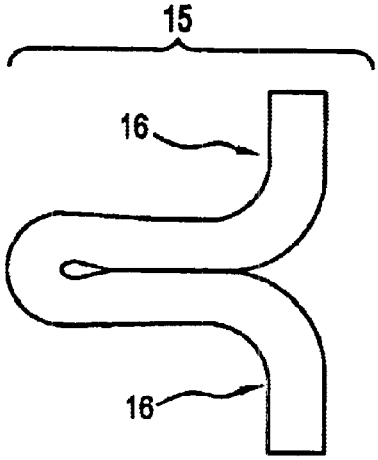
FIG. 8 is a top view of one embodiment of a T-shaped bar.
Figure 9:
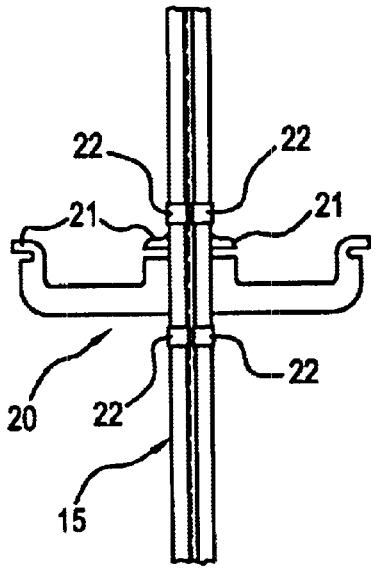
FIG. 9 is a side view of the clinching clip of FIG. 7 attached to the T-shaped bar of FIG. 8.
Figure 10:
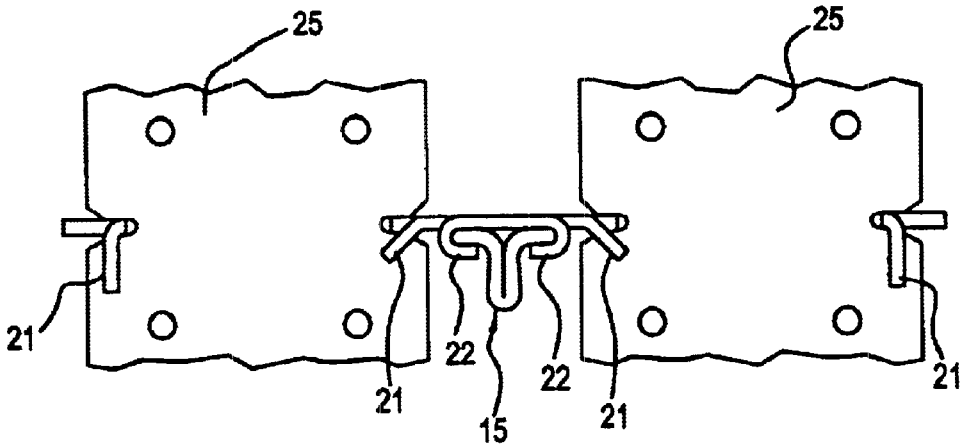
FIG. 10 is a top view of the clinching clip of FIG. 7 attached to the T-shaped bar of FIG. 8 and the insulator support structure of FIG. 2A.

The mounting structure 15 may include an outer surface having a round-shaped cross section with respect to an axis of the mounting structure 15 (see FIG. 1). As such, the second portion 22 (e.g., the tab 22) of the securement structure 20 may be welded to the outer surface of the mounting structure 15 (see FIGS. 1 and 6). Also, the mounting structure 15 may include an outer surface having a T-shaped cross section with respect to an axis of the mounting structure 15 (see FIG. 8). As such, the second portion 22 (e.g., the tab 22) of the securement structure 20 may be clinched and/or welded to the outer surface of the mounting structure 15 having the T-shaped cross section (see FIGS. 7–10). In addition, the mounting structure 15 may include a frame rail, for example, containing the outer surface having the round-shaped (see FIG. 1) and/or the T-shaped (see FIGS. 8–10) cross section with respect to an axis of the frame rail.

The tab 22 of the securement structure 20 may include a bendable clinching tab (see FIG. 7) that may be formed for clinching to the mounting structure 15 such as, for example, the tab receiving portion 16 of the mounting structure 15. The bendable clinching tab 22 of the securement structure 20 may include a T-shaped structure containing a ridge portion and a stem portion. The ridge portion of the securement structure 20 may include a set of end portions that form bendable flaps that are bendable around the mounting structure 15 (e.g., the tab receiving portion 16 of the mounting structure 15).

The second portion 27 of the insulator support structure 25 (see FIG. 2) cooperates with the terminal structure 30 (see FIG. 1) to releasably and fixedly secure the terminal structure 30 to the insulator support structure 25. The terminal receiving opening 29 may cooperate with the terminal structure 30 to releasably and fixedly secure the terminal structure 30 to the insulator support structure 25.

The terminal structure 30 may include an outer surface having at least one of a first shaped cross section and a second shaped cross section with respect to an axis of the terminal structure 30. The first shaped cross section may include one of round, square, rectangular and elliptical, and the second shaped cross section may include another of the one of round, square, rectangular and elliptical. The second portion 27 of the insulator support structure 25 may receive the first shaped cross section and/or the second shaped cross section.

The third portion 28 of the insulator support structure 25 cooperates with the first portion 36 of the conducting structure 35 to releasably and fixedly secure the conducting structure 35 to the insulator support structure 25. The conductor receiving opening 11 may cooperate with the first portion 36 of the conducting structure 35 to releasably and fixedly secure the conducting structure 35 to the insulator support structure 25.

The first portion 31 of the terminal structure 30 is coupled to the second portion 37 of the conducting structure 35, and the second portion 32 of the terminal structure 30 is coupled to the thermostat structure 40. The first portion 31 of the terminal structure 30 may be coupled to the second portion 37 of the conducting structure 35 by crimping around the first portion 31 of the terminal structure 30 to the second portion 37 of the conducting structure 35. The second portion 32 of the terminal structure 30 may include a fastener receiving opening 33 formed therethrough (see FIG. 11). The thermostat structure 40 may include a corresponding threaded fastener receiving opening (not shown) formed therethrough. To couple the terminal structure 30 to the thermostat structure 40, then the terminal structure 30 may be placed against the thermostat structure 40 with the fastener receiving openings in alignment. A fastener 41 (e.g., threaded bolt) may be inserted through the fastener receiving opening 33 of the terminal structure 30 and threaded onto the threaded fastener receiving opening of the thermostat structure 40 and tightened to couple the terminal structure 30 to the thermostat structure 40.

The insulator support structure 25 then supports the thermostat structure 40 and the conducting structure 35 in position.

An embodiment of a method for assembling the above-mentioned heater assembly 10 is provided. The method secures, through the securement structure 20, the insulator support structure 25 to the mounting structure 15. The method also secures the terminal structure 30 and the conducting structure 35 to the insulator support structure 25. The method further supports the thermostat structure 40 and the conducting structure 35 in position using the insulator support structure 25.

FIG. 1 illustrates a top view of another embodiment of a heater assembly 10, including a mounting structure 15, a securement structure 20, an insulator support structure 45, a terminal structure 50, and a conducting structure 35.

As described above, the securement structure 20 cooperates with the insulator support structure 45 and the mounting structure 15 to releasably and fixedly secure the insulator support structure 45 to the mounting structure 15.

Figure 3C:
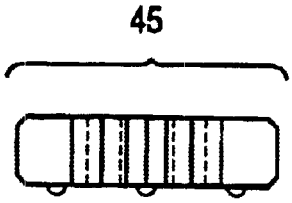
FIGS. 3A, 3B, and 3C are a side view, a top view, and an end view, respectively, of an insulator support structure in accordance with the embodiment of FIG. 1.
Figure 3A:
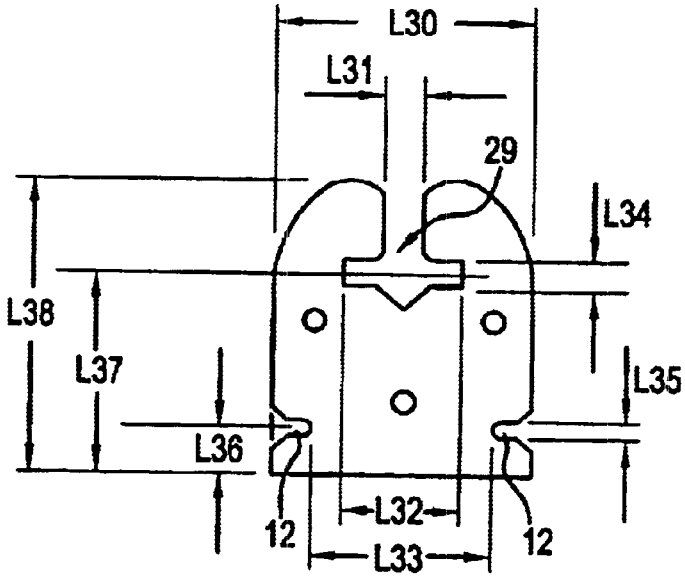
Figure 3B:
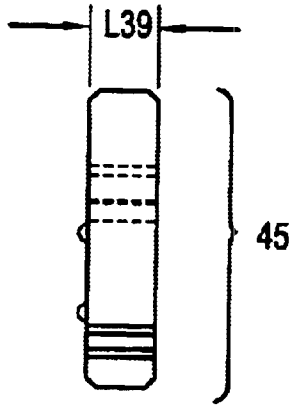

The insulator support structure 45 includes a terminal receiving opening 29 formed therethrough (see FIG. 3). The terminal structure 50 includes an outer surface having a first shaped cross section and/or a second shaped cross section with respect to an axis of the terminal structure 50, and it is coupled to the conducting structure 35. The terminal receiving opening 29 of the insulator support structure 45 cooperates with the terminal structure 50 to releasably and fixedly secure the terminal structure 50 to the insulator support structure 45. The terminal receiving opening 29 may be constructed and arranged to receive the first shaped cross section and the second shaped cross section of the terminal structure 50. The first shaped cross section may include one of round, square, rectangular and elliptical, and the second shaped cross section may include another of the one of round, square, rectangular and elliptical. The size of the insulator support structure 45 may include the following measurements (see FIGS. 3A and 3B): L30=0.870 in.; L31=0.132 in.; L32=0.395 in.; L33=0.625 in.; L34=0.070 in.; L35=0.050 in.; L36=0.156 in.; L37=0.689 in.; L38=1.004 in.; and L39=0.208 in.

Figure 5A:
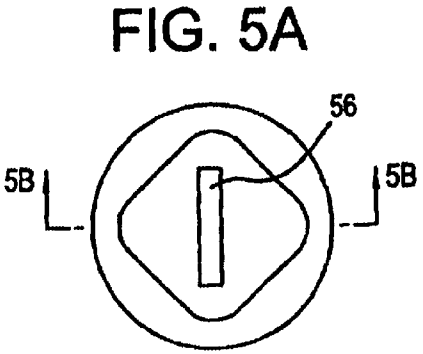
FIGS. 5A, 5B, and 5C are a front end view, a cross sectional view along line A—A of FIG. 5A, and a rear end view, respectively, of a female ceramic spacer structure in accordance with the embodiment of FIG. 1.
Figure 5B:
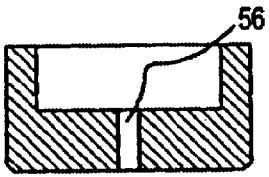
Figure 5C:
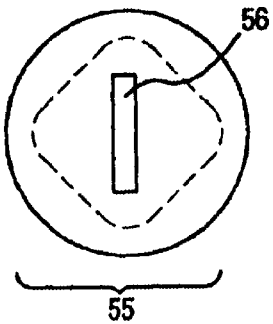
Figure 4A:
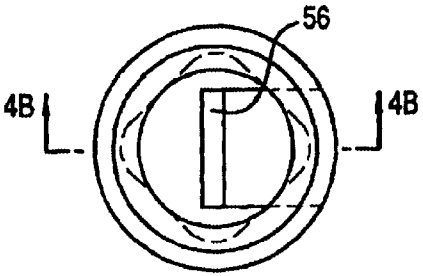
FIGS. 4A, 4B, and 4C are a front end view, a cross sectional view along line A—A of FIG. 4A, and a rear end view, respectively, of a male ceramic spacer structure in accordance with the embodiment of FIG. 1.
Figure 4B:
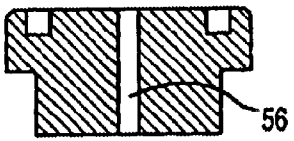
Figure 4C:
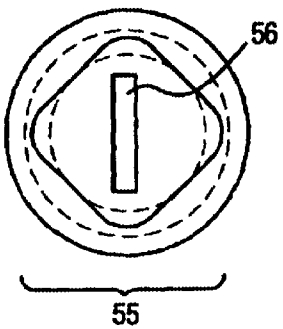

The insulator support structure 45 may be coupled to a spacer structure 55 (e.g., a male ceramic spacer (see FIG. 4)

and/or a female ceramic spacer (see FIG. 5)) to function as a support for a terminal structure delivering electrical power to a conducting structure. As such, the spacer structure 55 may include a terminal receiving opening 56 formed therethrough. To secure the terminal structure 50 to the insulator support structure 45, then the spacer structure 55 is placed against the insulator support structure 45 with the terminal receiving opening 56 of the spacer structure 55 and the terminal receiving opening 29 of the insulator support structure 45 in alignment, and the terminal structure 50 is inserted through the terminal receiving openings. The terminal structure 50 (see FIG. 1) may include a projection 51 to engage with the spacer structure 50 to secure the terminal structure 50 to the insulator support structure 45. FIG. 1 illustrates the heater assembly including a female ceramic spacer, illustrated in FIG. 5.

An embodiment of a method for assembling the above-mentioned heater assembly 10 is provided. The method secures, through the securement structure 20, the insulator support structure 45 to the mounting structure 15. The terminal structure 50 is coupled to the conducting structure 35. The method then secures the terminal structure 50 to the insulator support structure 45.

FIG. 1 illustrates a top view of a further embodiment of a heater assembly 10, including a mounting structure 15, a securement structure 20, an insulator support structure 25, 45 (e.g., the insulator support structure 25 and/or the insulator support structure 45, both of which may include a terminal receiving opening 29 formed therethrough), a conducting structure 35, a terminal structure 50, and a thermostat structure 40. The conducting structure 35 includes a first portion 38 and a second portion 37. The thermostat structure 40 may include an in-line thermostat structure.

As described above, the securement structure 20 (e.g., a clipping structure) cooperates with the insulator support structure 25, 45 and the mounting structure 15 to releasably and fixedly secure the insulator support structure 25, 45 to the mounting structure 15.

The terminal structure 50 is coupled to the first portion 38 of the conducting structure 35 to deliver power to the conducting structure 35. The thermostat structure 40 is directly or indirectly coupled to the second portion 37 of the conducting structure 35 (see, for example, above).

The insulator support structure 25, 45 is constructed and arranged to cooperate with both the terminal structure 50 and the thermostat structure 40 to support (e.g., fixedly support) the terminal structure 50 and/or the thermostat structure 40 in position. The terminal structure 50 and/or the thermostat structure 40 may include an outer surface having a first shaped cross section and/or a second shaped cross section with respect to an axis of the terminal structure 50 and/or the thermostat structure 40. The insulator support structure 25, 45 may be constructed and arranged to cooperate with the first shaped cross section and the second shaped cross section. The first shaped cross section may include one of round, square, rectangular and elliptical, and the second shaped cross section may include another of the one of round, square, rectangular and elliptical.

An embodiment of a method for assembling the above-mentioned heater assembly 10 is provided. The method secures, though the securement structure 20, the insulator support structure 25, 40 to the mounting structure 15. The terminal structure 50 and the thermostat structure 40 are coupled to the conducting structure 35. The method then supports the terminal structure 50 and/or the thermostat structure 40 in position using the insulator support structure 25, 40.

Thus, the heater assembly 10 may include an in-line thermostat, and insulator support structures, where the insulator support structures may be of one type and/or may be retained by clips welded to frame bars and/or clinched to T-shaped frame bars of the heater assembly 10. Also, the heater assembly 10 allows for the clips to be of one type, like the insulator support structures. As such, the heater assembly 10 allows, for example, for the use of more standardized parts and manufacturing procedures, and thereby the heater assembly 10 may be manufactured at a reduced cost, compared to presently known heater assemblies.

FIG. 1 then illustrates one embodiment of a heater assembly 10, for example, using half clips 20 (see, for example, FIG. 6, which illustrates a double welding clip) welded to frame bars 15. Other embodiments are also possible, for example, using half clips 20 (see, for example, FIG. 7, which illustrates a double clinching clip) clinched to T-shaped cross section frame bars 15 (see FIGS. 8–10), with flat bushings and/or point suspension insulators supporting the heating element coil 35 (e.g., electric heating coil).

FIGS. 2A and 2B illustrate one embodiment of a double ended flat insulator 25 having a first end with a first slot, a second end with a second slot, and a center portion with two slots (e.g., rectangular slots at opposite edges of the center portion). On the other hand, FIGS. 3A, 3B, and 3C illustrate one embodiment of a single ended flat insulator 45.

The two opposed, center slots allow the ceramic insulators 25, 45 to be retained, for example, by either of the embodiments of clips illustrated in FIGS. 6 and 7. The clip 20 of FIG. 6 allows an insulator to be supported, for example, to a frame bar by welding. The clip 20 of FIG. 7, on the other hand, allows an insulator to be supported, for example, to a frame bar by clinching. Half clip versions of FIGS. 6 and 7 may also be used.

The slots (e.g., closed and/or open slots) in the ends of the flat insulators of FIGS. 2 and 3 may be used, for example, for various functions. For instance, a slot may accept different types of terminal configurations such as a round cross section threaded terminal, a round cross section threaded terminal with a square shoulder and/or a flat blade terminal (e.g., a thermostat mounting blade terminal (see FIG. 11)). Also, the slot may allow the insulator to function as a support for a thermostat (e.g., an in-line thermostat) or as a ceramic to support a terminal delivering electrical power to a heating element. The flat insulators may be coupled to a spacer ceramic (see FIGS. 4 and 5) to function as a terminal support for delivering electrical power.

The size, shape, material, and/or arrangement of the mounting structure 15, the securement structure 20, the insulator support structure 25, 45, the terminal structure 30, 50, the conducting structure 35, and/or the thermostat structure 40 may be varied according to the preference of a user of the heater assembly 10. Also, an open coil electric heater may include an in-line thermostat that may be directly or indirectly mounted to a frame member by welding and/or clinching to a T-shaped cross section of the frame member. A flat ceramic may include a first opening on one end of the ceramic that is multifunctional (see, for example, above). The flat ceramic may also include two slots on opposite sides of a center portion of the ceramic for accepting clips for supporting the ceramic to the frame. Moreover, the ceramic may include a second opening on another end of the ceramic for supporting a helical wound resistance wire.

The disclosures of U.S. Pat. No. 6,509,554 entitled "Support Clips and Insulators for Use in Electric Heaters and Electric Heaters Containing Same," U.S. patent application No. 09/949,374 entitled "Support Apparatus for Resistive Coils and Insulators in Electric Heaters," and U.S. Pat. No. 6,433,318 entitled "Electric Heater Assembly with In-Line Thermostat," are herein incorporated by reference.

The foregoing presentation of the described embodiments is provided to enable any person skilled in the art to make or use the present invention. Various modifications to these embodiments are possible, and the generic principles presented herein may be applied to other embodiments as well. As such, the present invention is not intended to be limited to the embodiments shown above, and/or any particular configuration of structure but rather is to be accorded the widest scope consistent with the principles and novel features disclosed in any fashion herein.

What is claimed is:

1. A heater assembly comprising:

a mounting structure;

a securement structure;

an insulator support structure, including a first portion, a second portion, and a third portion;

a terminal structure, including a first portion, and a second portion;

a conducting structure, including a first portion, and a second portion; and a thermostat structure, wherein the securement structure is constructed and arranged to cooperate with the first portion of the insulator support structure and the mounting structure to releasably and fixedly secure the insulator support structure to the mounting structure, wherein the second portion of the insulator support structure is constructed and arranged to cooperate with the terminal structure to releasably and fixedly secure the terminal structure to the insulator support structure, wherein the third portion of the insulator support structure is constructed and arranged to cooperate with the first portion of the conducting structure to releasably and fixedly secure the conducting structure to the insulator support structure, wherein the first portion of the terminal structure is constructed and arranged to be coupled to the second portion of the conducting structure, and the second portion of the terminal structure is constructed and arranged to be coupled to the thermostat structure, and wherein the insulator support structure is constructed and arranged to support the thermostat structure and the conducting structure in position.

2. The heater assembly of claim 1, wherein the first portion of the insulator support structure includes a center portion of the insulator support structure, wherein the second portion of the insulator support structure includes a first end portion of the insulator support structure, and wherein the third portion of the insulator support structure includes a second end portion of the insulator support structure.

3. The heater assembly of claim 1, wherein the second portion of the insulator support structure includes a terminal receiving opening formed therethrough, and wherein the terminal receiving opening is constructed and arranged to cooperate with the terminal structure to releasably and fixedly secure the terminal structure to the insulator support structure.

4. The heater assembly of claim 3, wherein the terminal receiving opening of the insulator support structure is constructed and arranged to extend to an outer edge portion of the insulator support structure.

5. The heater assembly of claim 1, wherein the third portion of the insulator support structure includes a conductor receiving opening formed therethrough, and wherein the conductor receiving opening is constructed and arranged to cooperate with the first portion of the conducting structure to releasably and fixedly secure the conducting structure to the insulator support structure.

6. The heater assembly of claim 5, wherein the conductor receiving opening of the insulator support structure is constructed and arranged to extend to an outer edge portion of the insulator support structure.

7. The heater assembly of claim 1, wherein the securement structure includes a first portion to engage with the first portion of the insulator support structure, and a second portion to engage with the mounting structure.

8. The heater assembly of claim 7, wherein the first portion of the securement structure includes a tab, and wherein the first portion of the insulator support structure includes a tab receiving opening, constructed and arranged to receive the tab.

9. The heater assembly of claim 7, wherein the second portion of the securement structure includes a tab, and wherein the mounting structure includes a tab receiving portion, constructed and arranged to receive the tab.

10. The heater assembly of claim 7, wherein the second portion of the securement structure is welded to the mounting structure.

11. The heater assembly of claim 7, wherein the second portion of the securement structure includes a bendable clinching tab, constructed and arranged for clinching to the mounting structure.

12. The heater assembly of claim 11, wherein the mounting structure includes an outer surface having a T-shaped cross section with respect to an axis of the mounting structure, and wherein the bendable clinching tab of the securement structure is clinched to the outer surface of the mounting structure having the T-shaped cross section.

13. The heater assembly of claim 11, wherein the bendable clinching tab of the securement structure includes a T-shaped structure containing a ridge portion and a stem portion.

14. The heater assembly of claim 13, wherein the ridge portion of the securement structure includes a set of end portions, constructed and arranged to form bendable flaps that are bendable around the mounting structure.

15. The heater assembly of claim 7, wherein the second portion of the securement structure is constructed and arranged to be welded to and to be clinched to the mounting structure.

16. The heater assembly of claim 7, wherein the mounting structure includes a frame rail.

17. The heater assembly of claim 1, wherein the thermostat structure includes an in-line thermostat structure.

18. The heater assembly of claim 1, wherein the terminal structure includes an outer surface having at least one of a first shaped cross section and a second shaped cross section with respect to an axis of the terminal structure, and wherein the second portion of the insulator support structure is constructed and arranged to receive the first shaped cross section and the second shaped cross section.

19. The heater assembly of claim 18, wherein the first shaped cross section includes one of round, square, rectangular and elliptical, and wherein the second shaped cross section includes another of the one of round, square, rectangular and elliptical.

20. A heater assembly comprising:

a mounting structure;

a securement structure;

an insulator support structure, including a terminal receiving opening formed therethrough;

a terminal structure, including an outer surface having at least one of a first shaped cross section and a second shaped cross section with respect to an axis of the terminal structure; and a conducting structure, wherein the securement structure is constructed and arranged to cooperate with the insulator support structure and the mounting structure to releasably and fixedly secure the insulator support structure to the mounting structure, wherein the terminal structure is constructed and arranged to be coupled to the conducting structure, and wherein the terminal receiving opening of the insulator support structure is constructed and arranged to cooperate with the terminal structure to releasably and fixedly secure the terminal structure to the insulator support structure, and to receive the first shaped cross section and the second shaped cross section.

21. The heater assembly of claim 20, wherein the first shaped cross section includes one of round, square, rectangular and elliptical, and wherein the second shaped cross section includes another of the one of round, square, rectangular and elliptical.

22. The heater assembly of claim 20, wherein the securement structure includes a first portion to engage with the insulator support structure, and a second portion to engage with the mounting structure.

23. The heater assembly of claim 22, wherein the first portion of the securement structure includes a tab, and wherein the insulator support structure includes a tab receiving opening, constructed and arranged to receive the tab.

24. The heater assembly of claim 22, wherein the second portion of the securement structure includes a tab, and wherein the mounting structure includes a tab receiving portion, constructed and arranged to receive the tab.

25. The heater assembly of claim 22, wherein the second portion of the securement structure is welded to the mounting structure.

26. The heater assembly of claim 22, wherein the second portion of the securement structure includes a bendable clinching tab, constructed and arranged for clinching to the mounting structure.

27. The heater assembly of claim 26, wherein the mounting structure includes an outer surface having a T-shaped cross section with respect to an axis of the mounting structure, and wherein the bendable clinching tab of the securement structure is clinched to the outer surface of the mounting structure having the T-shaped cross section.

28. The heater assembly of claim 26, wherein the bendable clinching tab of the securement structure includes a T-shaped structure containing a ridge portion and a stem portion.

29. The heater assembly of claim 28, wherein the ridge portion of the securement structure includes a set of end portions, constructed and arranged to form bendable flaps that are bendable around the mounting structure.

30. The heater assembly of claim 22, wherein the second portion of the securement structure is constructed and arranged to be welded to and to be clinched to the mounting structure.

31. The heater assembly of claim 22, wherein the mounting structure includes a frame rail.

32. A heater assembly comprising:

a mounting structure;

a securement structure;

an insulator support structure;

a conducting structure, including a first portion and a second portion;

a terminal structure; and a thermostat structure, wherein the securement structure is constructed and arranged to cooperate with the insulator support structure and the mounting structure to releasably and fixedly secure the insulator support structure to the mounting structure, wherein the terminal structure is constructed and arranged to be coupled to the first portion of the conducting structure, and to deliver power to the conducting structure, wherein the thermostat structure is constructed and arranged to be coupled to the second portion of the conducting structure, and wherein the insulator support structure is constructed and arranged to cooperate with the terminal structure and the thermostat structure to fixedly support one of the terminal structure and the thermostat structure in position.

33. The heater assembly of claim 32, wherein at least one of the terminal structure and the thermostat structure includes an outer surface having at least one of a first shaped cross section and a second shaped cross section with respect to an axis of the at least one of the terminal structure and the thermostat structure, and wherein the insulator support structure is constructed and arranged to cooperate with the first shaped cross section and the second shaped cross section.

34. The heater assembly of claim 33, wherein the first shaped cross section includes one of round, square, rectangular and elliptical, and wherein the second shaped cross section includes another of the one of round, square, rectangular and elliptical.

35. The heater assembly of claim 32, wherein the securement structure includes a clipping structure.

36. The heater assembly of claim 32, wherein the securement structure includes a first portion to engage with the insulator support structure, and a second portion to engage with the mounting structure.

37. The heater assembly of claim 36, wherein the first portion of the securement structure includes a tab, and wherein the insulator support structure includes a tab receiving opening, constructed and arranged to receive the tab.

38. The heater assembly of claim 36, wherein the second portion of the securement structure includes a tab, and wherein the mounting structure includes a tab receiving portion, constructed and arranged to receive the tab.

39. The heater assembly of claim 36, wherein the second portion of the securement structure is welded to the mounting structure.

40. The heater assembly of claim 36, wherein the second portion of the securement structure includes a bendable clinching tab, constructed and arranged for clinching to the mounting structure.

41. The heater assembly of claim 40, wherein the mounting structure includes an outer surface having a T-shaped cross section with respect to an axis of the mounting structure, and wherein the bendable clinching tab of the securement structure is clinched to the outer surface of the mounting structure having the T-shaped cross section.

42. The heater assembly of claim 40, wherein the bendable clinching tab of the securement structure includes a T-shaped structure containing a ridge portion and a stem portion.

43. The heater assembly of claim 42, wherein the ridge portion of the securement structure includes a set of end portions, constructed and arranged to form bendable flaps that are bendable around the mounting structure.

44. The heater assembly of claim 36, wherein the second portion of the securement structure is constructed and arranged to be welded to and to be clinched to the mounting structure.

45. The heater assembly of claim 36, wherein the mounting structure includes a frame rail.

46. The heater assembly of claim 32, wherein the thermostat structure includes an in-line thermostat structure.

47. A method for assembling a heater comprising:

securing, through a securement structure, an insulator support structure to a mounting structure; and securing a terminal structure and a conducting structure to the insulator support structure; and supporting a thermostat structure and the conducting structure in position using the insulator support structure, wherein the insulator support structure includes a first portion, a second portion, and a third portion, wherein the terminal structure includes a first portion, and a second portion, wherein the conducting structure includes a first portion, and a second portion, wherein the securement structure is constructed and arranged to cooperate with the first portion of the insulator support structure and the mounting structure to releasably and fixedly secure the insulator support structure to the mounting structure, wherein the second portion of the insulator support structure is constructed and arranged to cooperate with the terminal structure to releasably and fixedly secure the terminal structure to the insulator support structure, wherein the third portion of the insulator support structure is constructed and arranged to cooperate with the first portion of the conducting structure to releasably and fixedly secure the conducting structure to the insulator support structure, and wherein the first portion of the terminal structure is constructed and arranged to be coupled to the second portion of the conducting structure, and the second portion of the terminal structure is constructed and arranged to be coupled to the thermostat structure.

48. The method of claim 47, wherein the first portion of the insulator support structure includes a center portion of the insulator support structure, wherein the second portion of the insulator support structure includes a first end portion of the insulator support structure, and wherein the third portion of the insulator support structure includes a second end portion of the insulator support structure.

49. The method of claim 47, wherein the second portion of the insulator support structure includes a terminal receiving opening formed therethrough, and wherein the terminal receiving opening is constructed and arranged to cooperate with the terminal structure to releasably and fixedly secure the terminal structure to the insulator support structure.

50. The method of claim 47, wherein the third portion of the insulator support structure includes a conductor receiving opening formed therethrough, and wherein the conductor receiving opening is constructed and arranged to cooperate with the first portion of the conducting structure to releasably and fixedly secure the conducting structure to the insulator support structure.

51. The method of claim 47, wherein the securement structure includes a first portion to engage with the first portion of the insulator support structure, and a second portion to engage with the mounting structure.

52. The method of claim 51, wherein the first portion of the securement structure includes a tab, and wherein the first portion of the insulator support structure includes a tab receiving opening, constructed and arranged to receive the tab.

53. The method of claim 51, wherein the second portion of the securement structure includes a tab, and wherein the mounting structure includes a tab receiving portion, constructed and arranged to receive the tab.

54. The method of claim 51, wherein the second portion of the securement structure is welded to the mounting structure.

55. The method of claim 51, wherein the second portion of the securement structure includes a bendable clinching tab, constructed and arranged for clinching to the mounting structure.

56. The method of claim 55, wherein the mounting structure includes an outer surface having a T-shaped cross section with respect to an axis of the mounting structure, and wherein the bendable clinching tab of the securement structure is clinched to the outer surface of the mounting structure having the T-shaped cross section.

57. The method of claim 51, wherein the second portion of the securement structure is constructed and arranged to be welded to and to be clinched to the mounting structure.

58. The method of claim 47, wherein the terminal structure includes an outer surface having at least one of a first shaped cross section and a second shaped cross section with respect to an axis of the terminal structure, and wherein the second portion of the insulator support structure is constructed and arranged to receive the first shaped cross section and the second shaped cross section.

59. The method of claim 58, wherein the first shaped cross section includes one of round, square, rectangular and elliptical, and wherein the second shaped cross section includes another of the one of round, square, rectangular and elliptical.

60. A method for assembling a heater comprising:

securing, through a securement structure, an insulator support structure to a mounting structure;

coupling a terminal structure to a conducting structure; and securing the terminal structure to the insulator support structure, wherein the insulator support structure includes a terminal receiving opening formed therethrough, wherein the terminal structure includes an outer surface having at least one of a first shaped cross section and a second shaped cross section with respect to an axis of the terminal structure, wherein the securement structure is constructed and arranged to cooperate with the insulator support structure and the mounting structure to releasably and fixedly secure the insulator support structure to the mounting structure, and wherein the terminal receiving opening of the insulator support structure is constructed and arranged to cooperate with the terminal structure to releasably and fixedly secure the terminal structure to the insulator support structure, and to receive the first shaped cross section and the second shaped cross section.

61. The method of claim 60, wherein the first shaped cross section includes one of round, square, rectangular and elliptical, and wherein the second shaped cross section includes another of the one of round, square, rectangular and elliptical.

62. The method of claim 60, wherein the securement structure includes a first portion to engage with the insulator support structure, and a second portion to engage with the mounting structure.

63. The method of claim 62, wherein the second portion of the securement structure is welded to the mounting structure.

64. The method of claim 62, wherein the second portion of the securement structure includes a bendable clinching tab, constructed and arranged for clinching to the mounting structure.

65. The method of claim 64, wherein the mounting structure includes an outer surface having a T-shaped cross section with respect to an axis of the mounting structure, and wherein the bendable clinching tab of the securement structure is clinched to the outer surface of the mounting structure having the T-shaped cross section.

66. The method of claim 62, wherein the second portion of the securement structure is constructed and arranged to be welded to and to be clinched to the mounting structure.

67. A method for assembling a heater comprising:

securing, though a securement structure, an insulator support structure to a mounting structure;

coupling a terminal structure and a thermostat structure to a conducting structure; and supporting one of the terminal structure and the thermostat structure in position using the insulator support structure, wherein the conducting structure includes a first portion and a second portion, wherein the securement structure is constructed and arranged to cooperate with the insulator support structure and the mounting structure to releasably and fixedly secure the insulator support structure to the mounting structure, wherein the terminal structure is constructed and arranged to be coupled to the first portion of the conducting structure, and to deliver power to the conducting structure, wherein the thermostat structure is constructed and arranged to be coupled to the second portion of the conducting structure, and wherein the insulator support structure is constructed and arranged to cooperate with the terminal structure and the thermostat structure to fixedly support one of the terminal structure and the thermostat structure in position.

68. The method of claim 67, wherein at least one of the terminal structure and the thermostat structure includes an outer surface having at least one of a first shaped cross section and a second shaped cross section with respect to an axis of the at least one of the terminal structure and the thermostat structure, and wherein the insulator support structure is constructed and arranged to cooperate with the first shaped cross section and the second shaped cross section.

69. The method of claim 68, wherein the first shaped cross section includes one of round, square, rectangular and elliptical, and wherein the second shaped cross section includes another of the one of round, square, rectangular and elliptical.

70. The method of claim 67, wherein the securement structure includes a clipping structure.

71. The method of claim 67, wherein the securement structure includes a first portion to engage with the insulator support structure, and a second portion to engage with the mounting structure.

72. The method of claim 71, wherein the second portion of the securement structure is welded to the mounting structure.

73. The method of claim 71, wherein the second portion of the securement structure includes a bendable clinching tab, constructed and arranged for clinching to the mounting structure.

74. The method of claim 73, wherein the mounting structure includes an outer surface having a T-shaped cross section with respect to an axis of the mounting structure, and wherein the bendable clinching tab of the securement structure is clinched to the outer surface of the mounting structure having the T-shaped cross section.

75. The method of claim 71, wherein the second portion of the securement structure is constructed and arranged to be welded to and to be clinched to the mounting structure.

* * * * *